US006896749B2

(12) United States Patent
Morere et al.

(10) Patent No.: US 6,896,749 B2
(45) Date of Patent: May 24, 2005

(54) ROLLED OR EXTRUDED ALUMINIUM AL-MN ALLOY PRODUCTS WITH IMPROVED CORROSION RESISTANCE

(75) Inventors: Bruce Morere, Voiron (FR); Isabelle Ronga, Saint-Egreve (FR); Jean-Louis Querbes, Millau (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 10/416,511

(22) PCT Filed: Jan. 9, 2002

(86) PCT No.: PCT/FR02/00059

§ 371 (c)(1),
(2), (4) Date: Sep. 9, 2003

(87) PCT Pub. No.: WO02/055750

PCT Pub. Date: Jul. 18, 2002

(65) Prior Publication Data

US 2004/0040634 A1 Mar. 4, 2004

(30) Foreign Application Priority Data

Jan. 12, 2001 (FR) ..... 01 00432

(51) Int. Cl.[7] ..... C22C 21/00
(52) U.S. Cl. ..... 148/437; 420/550; 420/553
(58) Field of Search ..... 148/437; 420/553, 420/550, 551, 552

(56) References Cited

U.S. PATENT DOCUMENTS

| | | | | |
|---|---|---|---|---|
| 4,167,410 A | * | 9/1979 | Anthony et al. | 420/528 |
| 4,334,935 A | * | 6/1982 | Morris | 148/551 |
| 6,284,386 B1 | * | 9/2001 | Jeffrey et al. | 428/457 |

FOREIGN PATENT DOCUMENTS

| | | |
|---|---|---|
| EP | 290358 | 11/1988 |
| WO | 97/46726 | 12/1997 |
| WO | 99/18250 | 4/1999 |
| WO | 00/50656 | 8/2000 |

* cited by examiner

*Primary Examiner*—Roy King
*Assistant Examiner*—Janelle Morillo
(74) *Attorney, Agent, or Firm*—Dennison, Schultz, Dougherty & MacDonald

(57) ABSTRACT

The invention concerns a rolled or extructed product, in particular a tube, made of an alloy composition (expressed in wt. %) comprising: Si<0.30; Fe 0.20–0.05; Cu<0.05; Mn 0.5–1.2; Mg<0.05; Zn<0.50; Cr 0.10–0.30; Ti<0.05; Zr<0.05; the balance consisting of aluminium and unavoidable impurities. The invention also concerns a method for making extruded tubes of said composition comprising casting a billet, optionally homogenizing it, extruding a tube, drawing said tube in one or several passes and continuous annealing at a temperature ranging between 350 and 500° C. with a temperature increase of less than 10 seconds. The inventive products are designed for pipes and heat exchangers for motor vehicles, and exhibit good corrosion resistance.

11 Claims, No Drawings

ROLLED OR EXTRUDED ALUMINIUM AL-MN ALLOY PRODUCTS WITH IMPROVED CORROSION RESISTANCE

FIELD OF THE INVENTION

The invention relates to rolled or extruded aluminium Al—Mn alloy products (series 3000 according to the Aluminium Association nomenclature) with improved corrosion resistance, and particularly to tubes intended largely for pipes or tubes and strips for use in heat exchangers for motor vehicles.

DESCRIPTION OF RELATED ART

The most frequently used alloys for tubes to be used as pipes for motor vehicles, and for tubes and strips for use in mechanically assembled automobile heat exchangers are manganese 3102, 3003 and 3103 alloys according to standard EN 573-3. These alloys are suitable for extrusion and have satisfactory mechanical properties. However, it became necessary to improve the corrosion resistance of these applications, which lead to the development of "long life" alloys.

Patent application WO 97/46726 by Reynolds Metals applies to an alloy known as X3030 with composition (% by weight):

Mn 0.1–0.5; Cu<0.03; Mg<0.01; Zn 0.06–1.0; Si 0.05–0.12; Fe<0.50; Ti 0.03–0.30; Cr<0.50, the balance consisting of aluminium. The addition of Zn and Ti contributes to improving the corrosion resistance. Cr is preferably held below 0.20% and the examples have contents of 0.005%, 0.05% and 0.10%. Fe is preferably kept below 0.30% and the examples have contents of 0.10%, 0.12% and 0.20%.

Patent application WO 99/18250 by the same company applies to an alloy known as X3020 with better formability than X3030 by the addition of Mg (up to 1%) and Zr (up to 0.30%). Cr is preferably kept below 0.02%, or even 0.01%. Fe is preferably kept below 0.30%.

Patent application WO 00/50656 by Norsk Hydro relates to an alloy with composition Si 0.05–0.15; Fe 0.06–0.35; Cu<0.10; Mn 0.01–1.0; Mg 0.02–0.60; Cr<0.25; Zn 0.05–0.70; Ti<0.25; Zr<0.20.

Cr is preferably kept below 0.15% and is only allowed to enable recycling of manufacturing waste from other alloys. Fe is preferably kept below 0.22%.

SUMMARY OF THE INVENTION

The purpose of the invention is to further improve the corrosion resistance compared with existing "long life" alloys.

The invention concerns a rolled or extruded product, in particular a tube, made of an alloy composition (expressed in wt. %) comprising:

Si<0.30; Fe 0.20–0.50; Cu<0.05; Mn 0.5–1.2; Mg<0.05; Zn<0.50; Cr 0.10–0.30; Ti<0.05 Zr<0.05; the balance consisting of aluminium and unavoidable impurities.

The preferred contents are Si<0.15; Fe 0.25–0.40; Mn 0.8–1.0; Cr 0.15–0.30; Zn 0.10–0.25.

The invention also concerns a method for making tubes extruded of said composition comprising casting a billet with the above composition, optionally homogenizing it, extruding a tube, drawing said tube in one or several passes and continuous annealing at a temperature ranging between 350 and 500° C. with a temperature increase of less than 10 seconds and preferably less than 2 seconds.

The invention also concerns a method for making strips with this composition, comprising casting a plate, hot rolling and then cold rolling it, and continuous annealing at a temperature ranging between 350 and 500° C. with a temperature increase of less than 10 minutes, and preferably less than 2 minutes.

DETAILED DESCRIPTION OF THE INVENTION

The alloy according to the invention has a manganese content of the same order of magnitude as the 3003 and 3103 alloys and contains almost no copper or magnesium. Unlike what is believed in prior art which recommends low iron contents for corrosion resistance, the behaviour of the alloy is good with an iron content of more than 0.20% and up to 0.50%. This avoids the need to use a more expensive pure aluminium base. Also unlike prior art, a chromium content of more than 0.10% and preferably 0.15% is shown to be favourable to corrosion resistance. Addition of a low content of zinc, less than 0.50% and preferably less than 0.20%, is also favourable.

The method for making extruded product, comprises casting the billets of the indicated alloy, homogenizing the billets, heating and extruding them to obtain a straight or ring tube, and one or several drawing passes to bring the product to the required dimensions. The tube is then annealed by taking it through a passage furnace, preferably an induction furnace, at high speed. The extruded product is heated very quickly, in less than 10 seconds and preferably in less than 2 seconds, and the product advances at a speed of between 20 and 200 m/mn. The furnace temperature is kept between 350 and 500° C. The product can then be drawn again to increase the mechanical strength.

This continuous annealing gives a microstructure with fine equiaxial grains, a medium grain size as measured by the intercepts method of less than 40 $\mu$m and typically of the order of 30 $\mu$m, while with conventional annealing in a static furnace, the grains are elongated with a much larger grain size of the order of 180 $\mu$m in the extrusion direction and 70 $\mu$m in the direction perpendicular to extrusion. The presence of chromium tends to further reduce the grain size by increasing the density of the recrystallisation sites, which has a beneficial effect on corrosion resistance.

The method for making strips comprises casting a plate with a composition according to the invention, optionally homogenizing this plate, hot rolling this plate to obtain a strip, cold rolling this strip to the required thickness and final recrystallisation annealing to a temperature ranging between 350 and 600° C. This final annealing is preferably done continuously in a passage furnace with a temperature increase in less than 10 minutes and preferably less than 2 minutes, which gives a fine grain size. The hot rolled strip may also be obtained directly by continuous casting, for example by casting between two cooled cylinders.

The products according to the invention have better corrosion resistance than the 3003 and 3103, and at least as good as "long life" alloys according to prior art, mechanical properties and formability equivalent to 3003 or 3103, and an economical production cost. They have an electromechanical corrosion potential practically identical to that of 3003 or 3103, such that there is no difference in behaviour of galvanic couples, for example the tube-fin couple in heat exchangers. The extrudability of extruded products is also at least as good as the extrudability of 3003 or 3103 alloys.

Extruded products according to the invention can be used particularly as fuel, oil or brake fluid pipes for automobiles and as tubes for heat exchangers in engine cooling systems and air conditioning systems for passenger compartments in motor vehicles. The strips may be used in the same heat exchangers for header pipes, evaporators and fins.

EXAMPLE

Billets made of 6 alloys identified A to F were cast and homogenized. The compositions of alloys A, B and C were the same as the compositions of 3003, 3103 and X3020 according to prior art. Alloys D and E are different from the invention in that D has a lower iron content and E contains titanium instead of chromium. The alloy F is conform with the invention. The compositions of the alloys (% by weight) are shown in table 1.

TABLE 1

| Ref. | Si | Fe | Cu | Mn | Mg | Cr | Zn | Ti |
|---|---|---|---|---|---|---|---|---|
| A | 0.09 | 0.19 | 0.15 | 1.05 | — | — | — | — |
| B | 0.12 | 0.55 | — | 1.10 | — | — | — | — |
| C | 0.07 | 0.08 | — | 0.95 | — | — | 0.17 | 0.14 |
| D | 0.08 | 0.10 | — | 1.00 | — | 0.20 | 0.01 | 0.02 |
| E | 0.07 | 0.26 | — | 0.98 | — | 0.01 | 0.01 | 0.14 |
| F | 0.08 | 0.27 | — | 0.98 | — | 0.19 | 0.17 | 0.01 |

The billets were extruded in coiled tubes and were then drawn to obtain a diameter of 12 mm and a thickness of 1.25 mm. No significant difference in terms of extrudability or drawing was found for any of the six alloys. These coiled tubes were continuously annealed in an induction furnace at a fixed temperature of 470° C. with an advance speed of between 60 and 120 m/min. The rings were then drawn once again to bring them into the H12 state according to standard EN 515. The ultimate strength $R_m$ (in MPa) and the yield stress $R_{0.2}$ (in MPa) were then measured on the samples of the 6 tubes. The results are given in table 2.

TABLE 2

| Alloy | A | B | C | D | E | F |
|---|---|---|---|---|---|---|
| $R_m$ | 116 | 120 | 106 | 112 | 112 | 116 |
| $R_{0.2}$ | 102 | 113 | 95 | 106 | 98 | 108 |

It can be seen that the mechanical strength of the alloy according to the invention is almost exactly the same as the alloy according to 3003 (A) or 3103 (B).

The corrosion resistance was measured using the SWAAT (salt water acetic acid test) test according to standard ASTM G85. Measurements were made for three different cycle times, 100, 400 and 800 cycles on two 200 mm tubes per alloy and per duration. At the end of the test, the tubes were taken out of the containment and were pickled using a 68% concentrated nitric acid solution to dissolve corrosion products. The depth of the 5 deepest pits formed was then measured on each tube, and the average for each tube and the average $P_{moy}$ of the values obtained for the two tubes were calculated. The corrosion resistance is better when $P_{moy}$ is smaller. The results are given in table 3.

TABLE 3

| Alloy | A | B | C | D | E | F |
|---|---|---|---|---|---|---|
| 100 cycles | 273 | 220 | 101 | 91 | 164 | 91 |
| 400 cycles | 462 | 375 | 213 | 134 | 151 | 124 |
| 800 cycles | 1054 | 431 | 368 | 260 | 387 | 249 |

It can be seen that alloy F according to the invention is the alloy that gives the best results, and therefore the iron content of 0.27% does not reduce the corrosion resistance, and the addition of 0.20% of chromium for alloys D and F has a significantly beneficial effect.

What is claimed is:

1. A rolled or extruded product, made of an alloy consisting essentially of, in weight %:

Si<0.30; Fe 0.25–0.50; Cu<0.05; Mn 0.5 1.2; Mg<0.05; Zn<0.50; Cr 0.10–0.30; Ti<0.05; Zr<0.05; the balance aluminum and unavoidable impurities.

2. Product according to claim 1, wherein Si<0.20%.

3. Product according to claim 1, wherein Fe is between 0.25 and 0.40%.

4. Product according to claim 1, wherein Mn is between 0.8 and 1.0%.

5. Product according to claim 1, wherein Cr is between 0.15 and 0.30%.

6. Product according to claim 1, wherein Zn is between 0.10 and 0.25%.

7. Product according to claim 1, which is an extruded product with grain size less than 40 um.

8. A pipe for a motor vehicle comprising an extruded product according to claim 1.

9. A tube for an automobile heat exchanger comprising an extruded product according to claim 1.

10. An element for an automobile heat exchanger comprising a strip according to claim 1.

11. Product according to claim 1, which is a tube.

* * * * *